US006160868A

United States Patent [19]

Snyder et al.

[11] Patent Number: 6,160,868

[45] Date of Patent: Dec. 12, 2000

[54] X-RAY TUBE APPARATUS EMPLOYING LIQUID METAL FOR HEAT REMOVAL

[75] Inventors: Douglas J. Snyder, Brookfield; Carey S. Rogers, Waukesha, both of Wis.

[73] Assignee: General Electric Company, Milwaukee, Wis.

[21] Appl. No.: 09/265,160

[22] Filed: Mar. 9, 1999

[51] Int. Cl.[7] ..... H01J 35/10

[52] U.S. Cl. ..... 378/127

[58] Field of Search ..... 378/127, 130

*Primary Examiner*—Craig E. Church

*Attorney, Agent, or Firm*—Skarsten Law Offices; Christian G. Cabou; Phyllis Y. Price

[57] ABSTRACT

Heat removal apparatus is provided for an X-ray tube having a frame, a shaft mounted for rotation with respect to the frame, and an anode supported on the shaft for rotation therewith. The apparatus comprises a heat transfer component, which is fixably joined to the frame in closely spaced relationship with an end portion of the rotatable shaft, and further comprises a radially, axially and tilt compliant sealing device, such as a flexible bellows, which is positioned to substantially enclose a space extending between the heat transfer component and a specified end portion of the shaft. A selected thermally conductive liquid metal, such as a gallium alloy, is contained within the enclosed space to provide a path for the flow of heat from the shaft to the heat transfer component, as the shaft and the anode rotate with respect to the frame. Such arrangement also permits expansion of the liquid metal, in the event of freezing.

20 Claims, 3 Drawing Sheets

X-RAY TUBE APPARATUS EMPLOYING LIQUID METAL FOR HEAT REMOVAL

BACKGROUND OF THE INVENTION

The invention disclosed and claimed herein generally pertains to improved apparatus for removing heat generated in an X-ray tube, as X-rays are produced thereby. More particularly, the invention pertains to heat removal apparatus of such type which employs a liquid metal having high thermal conductivity. Even more particularly, the invention pertains to apparatus of such type which has comparatively high tolerance to vibration and to misalignment of the anode support shaft.

As is well known in the art, in the operation of an X-ray tube a stream of electrons is directed across very high voltage, such as 100–140 KV, from a cathode to a focal spot position on a tungsten anode target. X-rays are produced as electrons strike the tungsten. However, the conversion efficiencies of such tubes are quite low. Accordingly, considerable heat is generated around the anode, as a byproduct of X-ray production.

In order to reduce heat concentration in regions proximate to the anode, the tungsten target is in the form of an annular track, and the focal spot position comprises a point along the track. The anode is rotatably mounted on a support shaft and rotated at high speeds. By means of such arrangement, the electron stream from the cathode is continually presented with a new and cooler surface. Nevertheless, in a high performance X-ray tube the surface of the anode may reach temperatures in excess of 2500° C., and regions of the anode outside the immediate target surface may rise to temperatures in excess of 1000° C. Thus, in the design of X-ray tubes provision must be made for the continuous removal of substantial amounts of heat. Moreover, the path of heat removal must be directed across a boundary between the anode and the anode bearing shaft, which are rapidly rotating members, and stationary X-ray tube support structure.

In a comparatively recent approach to heat removal, a quantity of liquid metal, referred to as a liquid metal plug, is placed around the anode support shaft at a position lying between two sets of bearings, which journal the shaft and anode for rotation. Such arrangements are generally not intended to bear any of the load which is placed on the shaft by the anode. The plug comprises liquid metal having high thermal conductivity, such as a gallium-tin alloy or the like. The liquid metal plug is intended to provide a heat flow path from the shaft to adjacent stationary support structure. Arrangements of this type are taught, for example, in U.S. patent application Ser. No. 09/134,113, entitled "X-ray Tube Rotor and Stator Assembly", which was filed Aug. 14, 1998 as a continuation in part of U.S. patent application Ser. No. 08/925,294, filed Sep. 8, 1997. Both such applications are commonly assigned herewith to the General Electric Company.

In the past, the problem of leakage has tended to make liquid metal plug designs of the above type unreliable for use in X-ray tubes. Leakage of the liquid metal can contaminate the bearing balls of the bearings which journal the anode shaft, leading to early bearing failure. Leakage can also lead to high voltage breakdown between different components in an X-ray tube, and can cause reduced thermal performance of the liquid metal plug. It will be seen that a liquid metal plug arrangement requires a seal of some type, to retain the liquid metal in contact with the anode support shaft. At the same time, a clearance must be provided between the seal and the shaft, to prevent interference with shaft rotation.

However, the tolerance which is allowed for the clearance is very tight. A clearance which is too large will result in leakage, while a clearance which is too small can result in metal to metal contact between stationary and rotating surfaces. Even if the clearance between rotating and stationary components is initially within the allowed tolerance required for successful operation, vibration of the rotating parts is likely to cause misalignment of the anode shaft. Displacement of the shaft could immediately result in the clearance becoming too large or too small. Moreover, the largest displacements induced by vibration tend to occur in regions which are proximate to the anode. As a result, previous liquid metal plug arrangements have generally not been placed in such regions. However, as stated above, the greatest concentration of heat in an X-ray tube is typically located near the anode, and in particular near the anode target. Accordingly, it would by very beneficial to provide a liquid metal plug device which could be positioned in close proximity thereto.

SUMMARY OF THE INVENTION

To overcome the above deficiencies, the invention provides apparatus wherein a thermally conductive liquid metal is contained in a floating seal, i.e., a mechanical sealing component which has high radial compliance. By using the floating component, a tight clearance can be maintained between the floating component and the anode support shaft or other rotating component of the X-ray tube, while at the same time allowing large displacements of the rotating component to occur. As stated above, such displacements may occur frequently, due to vibration of the rotating parts, or due to assembly misalignment.

The apparatus of the invention generally comprises a heat transfer component which is fixably joined to the frame of an X-ray tube, or other stationary structure thereof, in closely spaced relationship with a selected end portion of the rotatable assembly comprising the anode and anode support shaft. The apparatus further comprises a radially and tilt compliant sealing device which is positioned to substantially enclose or seal off a space extending between the heat transfer component and the selected rotatable end portion. A specified thermally conductive liquid metal is contained within the enclosed space, to provide a path for the flow of heat from the rotatable end portion to the heat transfer component, as the shaft and the anode carried thereby are rotated with respect to the frame.

In a preferred embodiment, the thermally conductive liquid metal comprises an alloy of gallium, such as a gallium-tin alloy. The radially compliant sealing device comprises a set of bellows having a first attachment structure joined to one side of the bellows, and a second attachment structure joined to the opposing side thereof. The first attachment structure comprises an annular flange, which is fixably joined to the frame to form a seal therewith. The second attachment structure comprises a tubular sleeve, which is fitted around the rotatable end portion in closely spaced relationship. Two different approaches, as described hereinafter in further detail, are provided to prevent liquid metal from leaking out of the sleeve. However, it is not intended to limit the invention thereto. By providing the compliant sealing device, leakage of the liquid metal is prevented, even when the support shaft is displaced or misaligned by excessive vibration. Moreover, the compliant sealing device allows the liquid metal to expand in the event of freezing, which could occur when the X-ray tube is shipped or stored in very cold temperatures.

In a further useful embodiment, the rotatable end portion extends outward from the anode so that the end portion and the radially compliant sealing device are in close proximity to the anode target. The apparatus of the invention is thereby enabled to remove heat directly from the region which is proximate to the anode target, significantly enhancing efficiency of the heat removal process.

DETAILED DESCRIPTION OF THE PREFERRED EMBODIMENT

Figure 1:
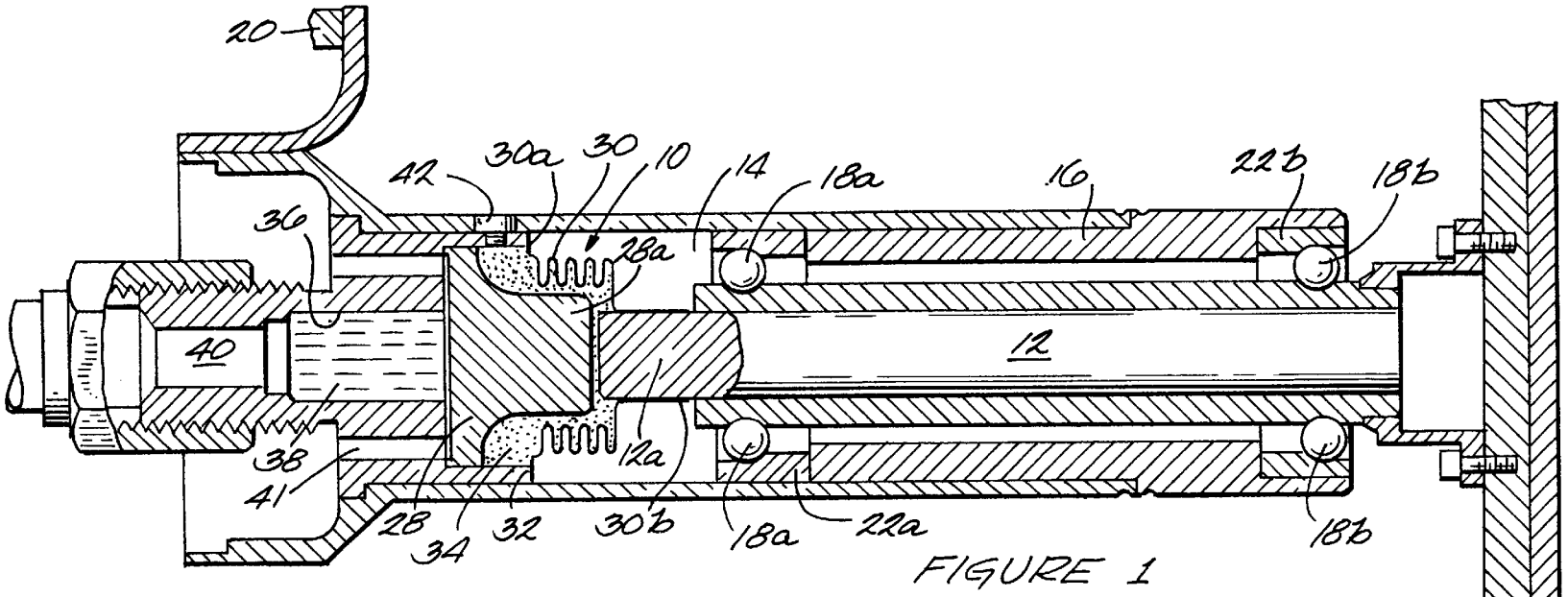
FIG. 1 is a sectional view showing an embodiment of the invention, in relationship with certain conventional X-ray tube components.

Referring to FIG. 1, there is shown heat removal apparatus 10, comprising an embodiment of the invention, in operative relationship with certain components which are conventionally employed in an X-ray tube. More particularly, FIG. 1 shows an anode bearing shaft 12 which is journaled for rotation, within the bore 14 of a tubular stem 16, by means of rotary bearings 18*a* and 18*b*. The leftward end of stem 16, as viewed in FIG. 1, is rigidly joined to a fixed X-ray tube frame through structure 20. Only a small portion of frame 20 is shown, for simplicity of illustration, since frame 20 may be of conventionally available design. Bearings 18*a* and 18*b* are held in place by means of bearing races 22*a* and 22*b*, respectively.

As is well known, an anode 24, comprising a solid circular disk, is joined to the rightward end of shaft 12, as viewed in FIG. 1, for rotation therewith. A target or target base 26 is positioned on the right side of anode 24, as viewed in FIG. 1, to support an annular track of tungsten or the like (not shown). To produce X-rays, a cathode (not shown) directs a stream of electrons (not shown) onto a small, continually changing segment of the rotating tungsten track. The electrons and track segment interact to generate X-rays. However, such interaction also produces a substantial amount of heat. As described hereinafter in further detail, apparatus 10 is provided to significantly improve efficiency in removing heat from an X-ray tube, while overcoming deficiencies of the prior art referred to above. To rotatably drive support shaft 12 and anode 24, rotor windings (not shown) are joined to shaft 12. The rotor windings are energized by means of spaced-apart stator windings (not shown) mounted on frame 20. Other conventional X-ray tube components, such as an outer cover therefor, are likewise not shown for simplicity of illustration.

Referring further to FIG. 1, there is shown a heat transfer component 28, which is fixably joined to frame 20 so that component 28 is in closely spaced relationship with the A leftward end of anode support shaft 12, as viewed in FIG. 1. Thus, component 28 is located proximate to the end of shaft 12 which is opposite the end thereof joined to anode 24. Component 28 is formed of a material having high thermal conductivity, such as copper or molybdenum. Preferably, bearing shaft 12 is formed of the same thermally conductive material. Thus, when large amounts of heat are produced in regions proximate to anode 24, during generation of X-rays, the heat will flow leftward along shaft 12, as viewed in FIG. 1, toward heat transfer component 28.

FIG. 1 further shows apparatus 10 comprising a set of flexible bellows 30, formed of material such as stainless steel, which are positioned in bore 14 around component 28, the leftward end of support shaft 12, and the gap therebetween. An annular flange 30*a* is formed on one side of bellows 30, integral therewith. Flange 30*a* is positioned in close abutting relationship with an annular shoulder 32 formed in X-ray tube frame 20. Moreover, flange 30*a* is joined to annular shoulder 32, such as by welding, to form a tight seal therewith. A tubular sleeve 30*b* is formed on the opposing side of bellows 30, likewise integral therewith. Sleeve 30*b* is fitted around end portion 12*a* of support shaft 12, in closely spaced relationship. More specifically, the clearance between bellows sleeve 30*b* and shaft end portion 12*a* is very tight, for example, on the order of 10–60 microns. Accordingly, the bellows 30 provides a wall or barrier which, together with a portion of frame 20, substantially encloses a space which surrounds an extended portion 28*a* of component 28, shaft end portion 12*a*, and the gap therebetween. This enclosed space is filled with a metal 34, which is in liquid form at the operating temperature of the X-ray tube, and which has high thermal conductivity. Liquid metal 34 may comprise, for example, a gallium-tin alloy, or other gallium alloy of a type which is well known in the art. Thus, it will be seen that heat which is conducted along support shaft 12, from anode 24 to shaft end portion 12*a*, will be transferred through the liquid metal 34 to the heat transfer component 28 with comparatively high efficiency.

FIG. 1 shows a portion of frame 20 configured to form a fluid reservoir 36. The reservoir is in adjacent relationship with heat transfer component 28, on the side thereof which is opposite to shaft end portion 12*a* and liquid metal 34. A cooling oil 38, of conventional type, is circulated through reservoir 36, through an inlet port 40 and exits at a port 41. Heat is thereby transferred to the oil 36 from the component 28, after flowing to component 28 through the liquid metal 34. FIG. 1 further shows a fill plug 42 inserted into a hole formed through frame 20, in communication with the space enclosed by bellows 30. Upon removal of the plug, liquid metal 34 can be inserted into the space.

Figure 2:
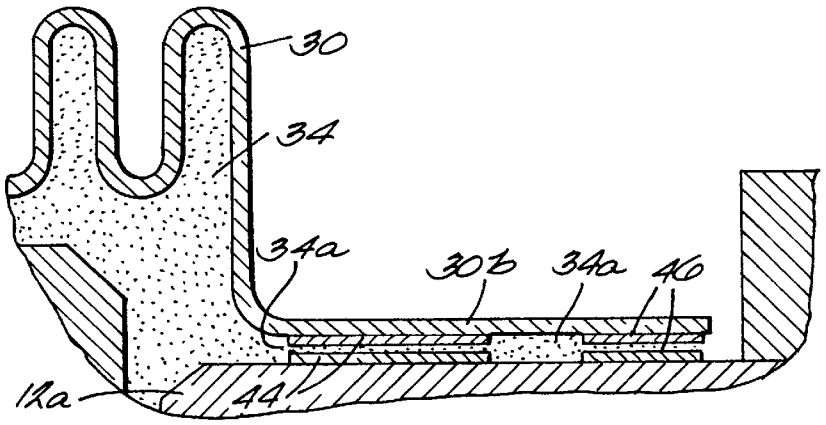
FIG. 2 is a sectional view showing a portion of the bellow sleeve of FIG. 1 in greater detail.

Referring to FIG. 2, there is shown a wetting agent 44, of a type well known to those skilled in the art, which is placed as a coating around the inside diameter of a portion of the bellows sleeve 30*b*. More specifically, wetting agent 44 is placed around the inside diameter of the sleeve portion which is adjacent to the bellows elements of bellows device 30, and to the liquid metal 34 contained therein. Wetting agent 44 is also placed around the ouside diameter of shaft end portion 12*a*, in closely spaced relation with the wetting agent around the sleeve. The wetting agent causes some of the liquid metal to flow into the gap between shaft end portion 12*a* and sleeve 30*b*, by means of capillary action, to provide a thin layer of liquid metal 34*a* therein. The layer of liquid metal in the gap provides a centering force, which acts to hold the sleeve 30*b* in concentric relationship with the shaft end portion 12*a*, notwithstanding the very tight clearance therebetween. The centering force is enhanced by rotation of the shaft 12, relative to the bellows sleeve 30*b*. It is to be understood that liquid metal layer 34*a* does not provide, and is not intended to provide, support for the anode 24 carried by the shaft 12.

Referring further to FIG. 2, there is shown an anti-wetting agent 46 which is placed as a coating around the inner diameter of the portion of sleeve 30*b* which is adjacent to the open end thereof. Anti-wetting agent 46 is also placed around the outside diameter of shaft end portion 12*a*, in closely spaced relation with the anti-wetting agent around sleeve 30*b*. Anti-wetting agent 46 serves to impede the flow of liquid metal 34. Acting in combination with the very tight clearance between bellows sleeve 30*b* and shaft end portion 12*a*, the anti-wetting agent 46 effectively prevents liquid metal 34 from leaking out of the bellows sleeve 30*b*. Anti-wetting agent 46 may comprise titanium nitride, or other substance of a type well known to those of skill in the art.

As stated above, vibration of the rotating parts in an X-ray tube can seriously affect prior art arrangements which use liquid metal to remove heat. The vibrations can misalign the shaft, i.e., displace the shaft so that its axis is tilted away from the true shaft axis orientation. Such displacement, in turn, tends to create a gap between the shaft and the liquid metal seal, which is sufficiently large that leakage occurs. However, by enclosing the liquid metal within bellows 30, and by fitting bellows sleeve 30*b* around the shaft end portion 12*a*, as described above in connection with FIGS. 1 and 2, such leakage is effectively prevented. The bellows 30 is both radially and axially compliant, and is also tilt compliant. Thus, if vibrations of the rotary anode or shaft cause displacement of the shaft end portion 12*a*, the bellows 30 will flex in accordance with the displacement. As a result, no force is applied to liquid metal layer 34*a* which is of sufficient strength to overcome the centering forces provided thereby, as described above. Accordingly, layer 34*a* continues to maintain the proper concentric relationship between shaft 12 and bellows sleeve 30, so that the tight clearance therebetween is held. Notwithstanding vibratory displacements of the shaft, such clearance will neither become large enough to allow leakage of the liquid metal nor small enough to cause solid to solid contact. Such contact can cause wear debris, which may damage the bearings. Also, by providing an axially compliant bellows, the above arrangement is particularly well suited to accommodate expansion of the liquid metal. As stated above, expansion could occur if the liquid metal encountered freezing conditions during transportation or storage.

Figure 3:
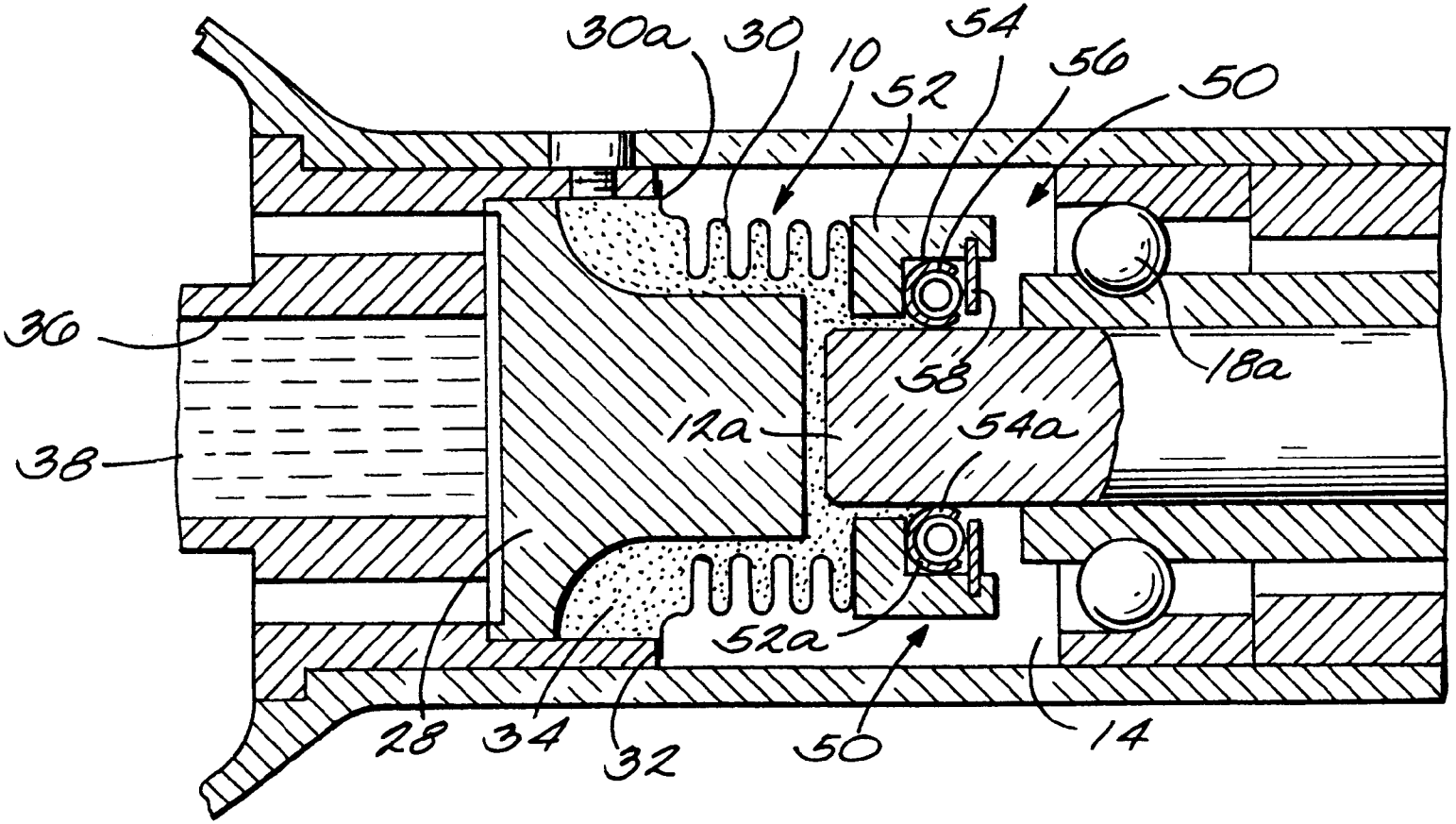
FIG. 3 is a sectional view showing a second embodiment of the invention.

Referring to FIG. 3, there is shown an embodiment of the invention which has been modified from the embodiment of FIG. 1 by substituting a sealing component 50 for the bellows sleeve 30*b*. Sealing component 50 includes a member 52, which is fitted around shaft end portion 12*a* in closely spaced relationship. Member 52 is joined to the right side of bellows 30, as viewed in FIG. 3, and supported thereby. An annular groove 52*a* is formed in member 52, and a metal C-ring 54 is inserted thereinto. A toroidal shaped spring 56, or like resilient member, is pressed against the concave side of C-ring 54, to urge the edges thereof outwardly. As a result, edge 54*a* of the C-ring is held in contact with the surface of shaft end portion 12*a*. Such contact is sufficient to prevent liquid metal 34 from leaking out of bellows 30, through the gap between member 52 and shaft end portion 12*a*. At the same time, only a small surface area of curved edge 54*a* of the C-ring contacts shaft end 12*a*. Accordingly, metal to metal contact is minimal, and C-ring 54 does not impede rotation of shaft 12.

Referring further to FIG. 3, there is shown a retaining ring 58 joined to member 52, to hold C-ring 54 and spring 56 in place. Other seal designs are also possible.

Figure 4:
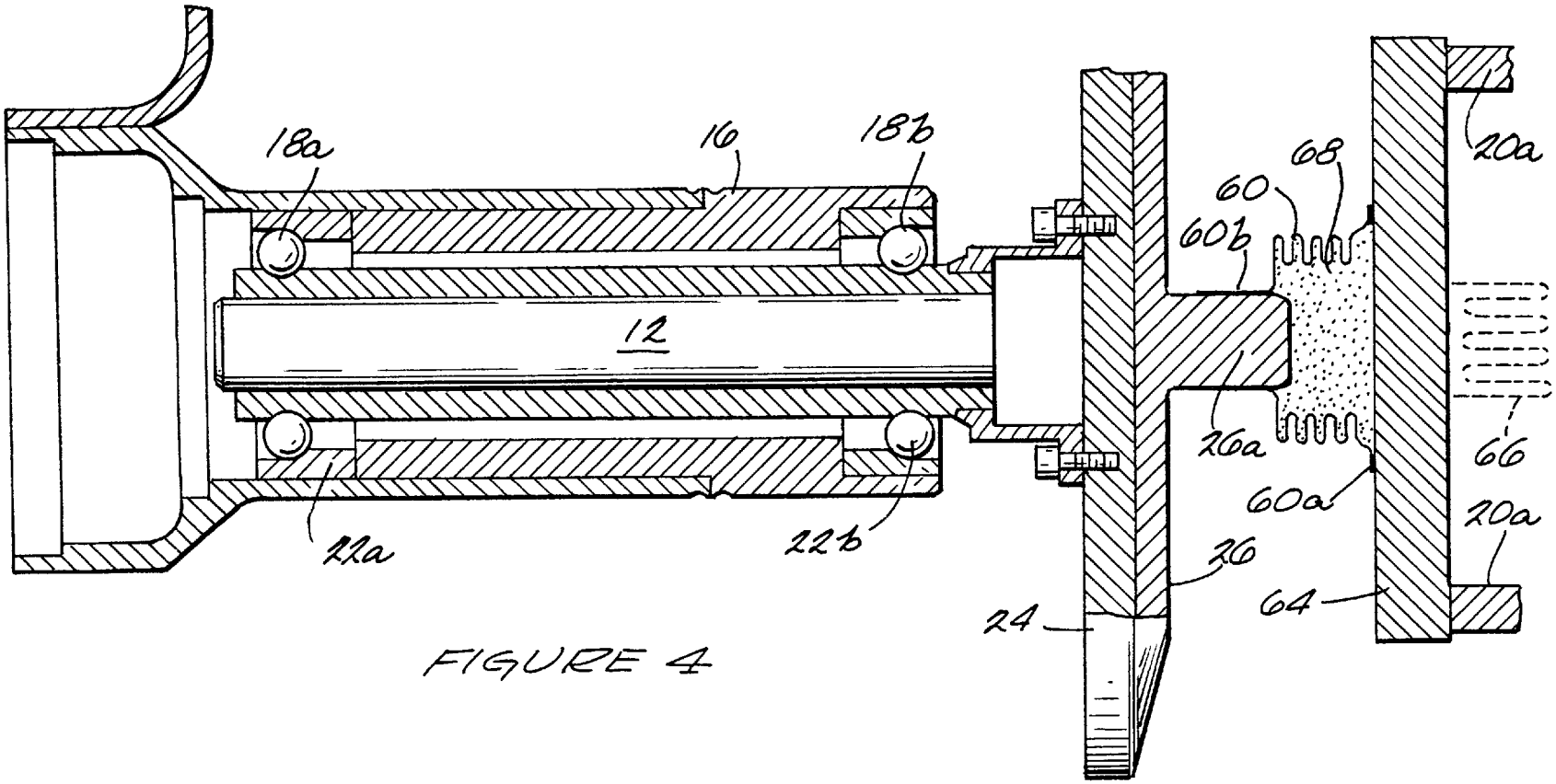
FIG. 4 is a sectional view showing a third embodiment of the invention.

Referring to FIG. 4, there is shown the anode 24 mounted on the support shaft 12, as described above in connection with FIG. 1. In addition however, the arrangement of FIG. 4 shows target 26 provided with an elongated integral end portion 26*a*. End portion 26*a* extends rightward from anode 24, as viewed in FIG. 4. Both target 26 and the end portion 26*a* are formed of a thermally conductive material such as a molybdenum alloy. FIG. 4 further shows a plate member 64, which is spaced apart from end portion 26*a* and is fixably held in place with respect to X-ray tube frame 20, such as by means of frame components 20*a*.

Referring further to FIG. 4, there is shown a bellows 60, which is similar or identical to the bellows 30 described above. Thus, bellows 60 has an annular flange 60*a* formed on one of its sides, and integral therewith, and a tubular sleeve 60*b* formed on its other side, likewise integral therewith. Flange 60*a* is sealably joined to plate member 64, such as by welding, and sleeve 60*b* is fitted around end portion 26*a* in close fitting relationship, so that there is the same tight clearance therebetween as described above in connection with sleeve 30*b* and shaft end portion 12*a*. Thus, bellows 60 substantially encloses a space which is filled with a liquid metal 68, comprising the same metal or material used for previously described liquid metal 34.

As stated above, the greatest concentration of heat in the arrangement shown in FIG. 4 is in the region proximate or adjacent to anode 24, and particulary adjacent to target 26. By providing target end portion 26*a*, in combination with bellows 60 and the thermally conductive liquid metal 68, a heat flow path is established for readily drawing heat away from target 26 and anode 24 to the plate member 64. Preferably, plate member 64 comprises a thermally conductive material, such as copperor molybdenum. Usefully, cooling fins 66 are mounted on plate member 64, to assist in the dissipation of heat therefrom. As described above in connection with bellows 30, the bellows 60 is a radially, axially and tilt compliant device. Accordingly, the bellows 60 will sealably retain the liquid metal 58, notwithstanding vibratory displacements or assembly misalignments of anode 24 and shaft 12. This is very important since, as likewise stated above, the vibratory displacements are greatest in the region proximate to the anode.

Obviously, other modifications and variations of the present invention are possible in light of the above teachings. It is therefore to be understood that within the scope of the disclosed concept, the invention may be practiced otherwise than as specifically described.

What is claimed is:

1. In an X-ray tube provided with a frame, and further provided with a rotatable assembly comprising a shaft mounted for rotation with respect to the frame and an anode supported on the shaft for rotation therewith, heat removal apparatus comprising:

a heat transfer component fixably joined to said frame in selectively spaced relationship with a selected end portion of said rotatable assembly;

a radially and tilt compliant sealing device positioned to substantially enclose a space extending between said heat transfer component and said selected rotatable end portion; and a selected thermally conductive liquid metal contained within said enclosed space to provide a path for the flow of heat from said rotatable end portion to said heat transfer component, as said shaft and said anode rotate with respect to said frame.

2. The apparatus of claim 1 wherein:

said sealing device comprises a set of flexible bellows having a first attachment structure joined to one side of said bellows, and a second attachment structure joined to an opposing side of said bellows.

3. The apparatus of claim 2 wherein:

said first attachment structure comprises an annular flange which is fixably joined to said frame to form a seal therewith; and said second attachment structure is fitted around said rotatable end portion in closely spaced relationship to provide a gap therebetween which is disposed to receive a thin layer of said liquid metal, said liquid metal layer acting to apply a centering force to said shaft and to said anode during rotation.

4. The apparatus of claim 3 wherein:

said second attachment structure comprises a tubular sleeve.

5. The apparatus of claim 4 wherein:

a first portion of the inside diameter of said sleeve is coated with a selected wetting agent, and a second portion of the inside diameter of said sleeve, which is adjacent to the open end thereof, is coated with an anti-wetting agent.

6. The apparatus of claim 2 wherein:

said second attachment structure comprises a member which is fitted around said rotatable end portion in closely spaced relationship, an annular groove being formed in said member and a C-ring being inserted into said groove to seal the gap between said member and said rotatable end portion, to prevent leakage of said liquid metal from said bellows.

7. The apparatus of claim 6 wherein:

said second attachment structure further comprises a spring disposed to urge an edge of said C-ring into contact with said rotatable end portion, and a retaining ring joined to said member to hold said C-ring and said spring in place.

8. The apparatus of claim 1 wherein:

said rotatable end portion extends outward from said anode, and is proximate to a target supported by and rotatable with said anode.

9. The apparatus of claim 1 wherein:

said anode is mounted at a specified distance from said rotatable end portion, and a section of said shaft extending between said anode and said end portion is formed of specified thermally conductive material.

10. The apparatus of claim 1 wherein:

said liquid metal comprises a specified gallium alloy.

11. The apparatus of claim 1 wherein:

said heat transfer component is provided with a reservoir containing selected cooling oil.

12. The apparatus of claim 1 wherein:

said heat transfer component comprises a plate member formed of specified thermally conductive material.

13. The apparatus of claim 1 wherein:

said heat transfer component is formed of specified thermally conductive material, and has an extended portion in contact with said liquid metal.

14. In an X-ray tube provided with a frame and with a rotatable assembly comprising a shaft mounted for rotation with respect to the frame and an anode supported on the shaft for rotation therewith, heat removal apparatus comprising:

means for dissipating heat joined to said frame;

sealing means tolerant to vibration and to misalignment for substantially enclosing a space extending between said heat dissipating means and a selected rotatable end portion of said assembly; and a selected thermally conductive liquid metal contained within said space to provide a path for the flow of heat from said rotatable end portion to said heat dissipating means, as said shaft and said anode rotate with respect to said frame.

15. The apparatus of claim 14 wherein:

said sealing means comprises a set of flexible bellows having a first attachment means joined to one side thereof and a second attachment means joined to an opposing side thereof, said bellows, said first attachment means, and said second attachment means comprising an integral structure.

16. The apparatus of claim 15 wherein:

said sealing means comprises a set of radially and tilt compliant bellows, said bellows also being axially compliant to permit expansion of said liquid metal in the event of freezing.

17. The apparatus of claim 15 wherein:

said first attachment means comprises an annular flange which is fixably joined to said frame to form a seal therewith; and said second attachment means comprises means fitted around said rotatable end portion in closely spaced relationship for employing a small amount of said liquid metal to apply a centering force to said shaft and to said anode during rotation.

18. The apparatus of claim 17 wherein:

said second attachment means comprises a tubular sleeve which employs a selected anti-wetting agent adjacent to an open end of said sleeve to prevent leakage of said liquid metal from said bellows.

19. The apparatus of claim 17 wherein:

said second attachment means comprises a member fitted around said rotatable end portion, and a C-ring supported by said member to seal the gap between said member and said rotatable end portion, to prevent leakage of said liquid metal from said bellows.

20. The apparatus of claim 17 wherein:

said rotatable end portion extends outward from said anode, and is proximate to a target supported by and rotatable with said anode.

* * * * *